US009567553B2

(12) United States Patent
Mbengue

(10) Patent No.: US 9,567,553 B2
(45) Date of Patent: Feb. 14, 2017

(54) CLEANING COMPOSITION SUSPENSION FOR SPRAY BOTTLE DISPERSAL

(71) Applicant: Omar Mbengue, Dayton, OH (US)

(72) Inventor: Omar Mbengue, Dayton, OH (US)

( * ) Notice: Subject to any disclaimer, the term of this patent is extended or adjusted under 35 U.S.C. 154(b) by 0 days.

(21) Appl. No.: 14/975,586

(22) Filed: Dec. 18, 2015

(65) Prior Publication Data

US 2016/0177234 A1 Jun. 23, 2016

Related U.S. Application Data

(60) Provisional application No. 62/094,150, filed on Dec. 19, 2014.

(51) Int. Cl.

| | |
|---|---|
| ***C11D 3/382*** | (2006.01) |
| ***C11D 7/46*** | (2006.01) |
| ***C11D 3/20*** | (2006.01) |
| ***C11D 3/10*** | (2006.01) |

(52) U.S. Cl.

CPC ..... *C11D 3/382* (2013.01); *C11D 3/10* (2013.01); *C11D 3/2079* (2013.01)

(58) Field of Classification Search

CPC ..... C11D 7/46; C11D 3/382; C11D 7/265; C11D 11/0023

See application file for complete search history.

(56) References Cited

U.S. PATENT DOCUMENTS

| | | | | |
|---|---|---|---|---|
| 3,764,678 | A | 10/1973 | Knusli et al. | |
| 6,384,010 | B1 | 5/2002 | Wagers | |
| 6,780,228 | B2 | 8/2004 | Mason et al. | |
| 6,841,090 | B1 | 1/2005 | Allighieri et al. | |
| 7,625,855 | B2 | 12/2009 | Gonzalez | |
| 8,206,761 | B2 | 6/2012 | Kutumian | |
| 2010/0323046 | A1* | 12/2010 | Rolland | A23L 2/39 424/778 |
| 2012/0244086 | A1 | 9/2012 | Trivedi et al. | |
| 2014/0010930 | A1 | 1/2014 | Barbeau | |
| 2014/0106009 | A1* | 4/2014 | Matheson | A61K 36/185 424/727 |
| 2014/0249902 | A1* | 9/2014 | Isaacson | G06Q 30/0217 705/14.19 |

* cited by examiner

*Primary Examiner* — Charles Boyer

(74) *Attorney, Agent, or Firm* — The Keys Law Firm PLLC

(57) ABSTRACT

A cleaning composition suspension for use as a liquid anti-microbial cleaner which is non-toxic to the extent that it is safe to ingest includes a base diluted vinegar solution which includes sodium bicarbonate dissolved therein and dried and powdered plant matter suspended therein. The dried and powdered plant matter includes prepared leaves from *Guiera Senegalensis, Combretum micranthum*, and *Combretum glutinosum* along with prepared flowers from *Hibiscus Sabdariffa*. The dried and powdered plant matter may additionally include an anti-caking agent and are prepared in such a manner that they may be stored in and dispensed from a conventional spray bottle similar to conventional cleaning agents.

7 Claims, No Drawings

CLEANING COMPOSITION SUSPENSION FOR SPRAY BOTTLE DISPERSAL

CROSS REFERENCE TO RELATED APPLICATIONS

This application claims the benefit of and incorporates by reference U.S. provisional patent application Ser. No. 62/094,150 filed Dec. 19, 2014.

BACKGROUND OF THE INVENTION

Field of the Invention

This invention relates generally to cleaning compositions and, more particularly, to an all natural cleaning suspension employing natural leaf active ingredients and that is suitable for use with conventional spray bottles.

Description of the Prior Art

The use of various compositions as detergents and other cleaning agents for surfaces is well known. A problem which still exists, however, is that many existing cleaning compositions often include toxic ingredients and/or components that are harsh on surfaces to be cleaned or on the skin of a user. Thus, there remains a need for a cleaning composition suspension that employs as primary active ingredients dried plant components. It would be helpful if such a cleaning composition suspension had a liquid base that included vinegar to enhance its cleaning properties. It would be additionally desirable for such a cleaning composition suspension to include suspended particles that were small enough that the suspension was useable in a spray bottle.

The Applicant's invention described herein provides for a cleaning composition suspension adapted to provide a liquid based cleaning agent that was non-toxic to the extent that it is safe to ingest. The primary components in Applicant's cleaning composition suspension are a base solution, defined as a liquid base with sodium bicarbonate dissolved therein, and dried and powdered plant matter. When in operation, the cleaning composition suspension enables the deployment of an anti-bacterial cleaning agent through a spray bottle. As a result, many of the limitations imposed by prior art structures are removed.

SUMMARY OF THE INVENTION

A cleaning composition suspension for use as a liquid anti-microbial cleaner which is non-toxic to the extent that it is safe to ingest. The cleaning composition suspension comprises a base diluted vinegar solution which includes sodium bicarbonate dissolved therein and dried and powdered plant matter suspended therein. In one embodiment, the dried and powdered plant matter includes prepared leaves from *Guiera Senegalensis, Combretum micranthum*, and *Combretum glutinosum* along with prepared flowers from *Hibiscus Sabdariffa*. In some embodiments, the dried and powdered plant matter additionally includes an anti-caking agent. It is contemplated that the cleaning composition suspension may be stored in and dispensed from a conventional spray bottle similar to conventional cleaning agents.

It is an object of this invention to provide a cleaning composition suspension that employs as primary active ingredients dried plant components.

It is another object of this invention to provide a cleaning composition suspension which has a liquid base that included vinegar to enhance its cleaning properties.

It is yet another object of this invention to provide a cleaning composition suspension which includes suspended particles that were small enough that the suspension was useable in a spray bottle.

These and other objects will be apparent to one of skill in the art.

DETAILED DESCRIPTION OF THE INVENTION

A cleaning composition suspension in accordance with the present invention defines a base solution having dried and powdered plant matter suspended therein. In the preferred embodiment, the base solution defines a liquid base having sodium bicarbonate dissolved therein. In the preferred embodiment, the liquid base defines an acetic acid and water mixture. Accordingly, it is contemplated that the liquid base in the preferred embodiment essentially defines a diluted vinegar solution. It is further contemplated that when the cleaning composition suspension in accordance with the present invention is prepared, a portion of sodium bicarbonate is introduced to the liquid base and dissolved therein to form the base solution prior to introducing the dried and powdered plant matter to the base solution.

In the preferred embodiment, the dried and powdered plant matter includes prepared leaves from *Guiera Senegalensis, Combretum micranthum*, and *Combretum glutinosum* along with prepared flowers from *Hibiscus Sabdariffa*. The leaves and flowers are prepared in essentially the same way: first being dried and then being ground into a very fine powder for introduction to the base solution. In some embodiments, the dried and powdered plant matter additionally includes an anti-caking agent, such as tricalcium phosphate or calcium silicate.

Once the dried and powdered plant matter is mixed into the base solution, it is mixed together to form a suspension. This suspension may then be placed in a conventional spray bottle and dispensed therefrom as conventional cleaning agents.

It is specifically contemplated that the cleaning composition suspension may be employed to clean and disinfect kitchen surfaces and materials (or other areas where food or water is consumed) as any residue or stray spraying can be safely ingested and therefore provides no threat to animals or people in the vicinity.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A cleaning composition suspension, comprising:

a base solution defining a liquid base which includes acetic acid and water;

a plant matter mix which includes at least one of dried and powdered leaves from *Guiera Senegalensis*, dried and powdered leaves from *Combretum micranthum*, dried and powdered leaves from *Combretum glutinosum*, and dried and powdered flowers from *Hibiscus Sabdariffa*; and wherein base solution includes said plant matter mix suspended therein.

2. The cleaning composition suspension of claim 1, additionally comprising sodium bicarbonate, wherein said sodium bicarnonate is dissolved in the base solution.

3. The cleaning composition suspension of claim 1, additionally comprising an anti caking agent, wherein said anti caking agent is included in said plant matter mix.

4. The cleaning composition suspension of claim 1, wherein the plant matter mix includes dried and powdered leaves from *Guiera Senegalensis*, dried and powdered leaves from *Combretum micranthum*, dried and powdered leaves from *Combretum glutinosum*, and dried and powdered flowers from *Hibiscus Sabdariffa*.

5. A cleaning composition suspension, comprising:

a base solution defining a liquid base which includes acetic acid and water;

said base solution additionally including sodium bicarnonate dissolved therein;

a plant matter mix which includes dried and powdered leaves from *Guiera Senegalensis*, dried and powdered leaves from *Combretum micranthum*, dried and powdered leaves from *Combretum glutinosum*, and dried and powdered flowers from *Hibiscus Sabdariffa*; and wherein base solution includes said plant matter mix suspended therein.

6. The cleaning composition suspension of claim 1, additionally comprising an anti caking agent, wherein said anti caking agent is included in said plant matter mix.

7. A cleaning composition suspension, consisting essentially of:

a base solution defining a liquid base which includes acetic acid and water;

said base solution additionally including sodium bicarnonate dissolved therein;

a plant matter mix which includes an anti caking agent, dried and powdered leaves from *Guiera Senegalensis*, dried and powdered leaves from *Combretum micranthum*, dried and powdered leaves from *Combretum glutinosum*, and dried and powdered flowers from *Hibiscus Sabdariffa*; and wherein base solution includes said plant matter mix suspended therein.

* * * * *